United States Patent [19]

Beck et al.

[11] 4,092,107

[45] May 30, 1978

[54] PROCESS FOR FINISHING TEXTILE MATERIALS CONTAINING CELLULOSE FIBERS

[75] Inventors: Heinz Beck, Duren; Gerhard Schlichtmann, Wuppertal, both of Germany

[73] Assignee: Akzona Incorporated, Asheville, N.C.

[21] Appl. No.: 682,263

[22] Filed: May 3, 1976

[30] Foreign Application Priority Data

May 7, 1975 Germany ..... 2520224

[51] Int. Cl.[2] ..... D06M 15/40

[52] U.S. Cl. ..... 8/116 R; 8/115.7; 8/187; 8/195; 8/120; 8/DIG. 18; 252/8.6; 428/290; 252/8.6

[58] Field of Search ..... 8/115.6, 115.7, 116 R, 8/DIG. 18, 120; 428/290

[56] References Cited

U.S. PATENT DOCUMENTS

| | | | |
|---|---|---|---|
| 3,377,249 | 4/1968 | Marco | 8/115.6 |
| 3,676,207 | 7/1972 | Lofton et al. | 8/116 R |
| 3,794,465 | 2/1974 | Baron | 8/115.6 |

FOREIGN PATENT DOCUMENTS

| | | |
|---|---|---|
| 1,719,370 | 10/1971 | Germany. |
| 2,152,596 | 4/1973 | Germany. |

OTHER PUBLICATIONS

American Dyestuff Reporter, Jun. 2, 1969, vol. 58, No. 11, pp. 16–19 (Scientific Library).

*Primary Examiner*—John Kight, III
*Attorney, Agent, or Firm*—Stevens, Davis, Miller & Mosher

[57] ABSTRACT

A process is provided for finishing fabric containing cellulose fibers to improve its crease resistance, soil release and wet soiling properties while retaining a hand similar to that of the fabric prior to finishing wherein a latex containing a cross-linkable resin which will impart crease resistance to a fabric contains the polymerization product of a mixture of from 70% to about 97% by weight of an ester of acrylic acid and a saturated monohydric alcohol having 1 to 8 carbon atoms and from about 30 to 3% of an ester of acrylic acid and an unsaturated monohydric alcohol having 2 to 5 carbon atoms.

11 Claims, No Drawings

PROCESS FOR FINISHING TEXTILE MATERIALS CONTAINING CELLULOSE FIBERS

This invention relates generally to the finishing of textiles and more particularly to a process for finishing wash and wear fabrics made from fibers containing cellulose fibers.

It is known that a textile material containing cellulose fibers may be finished with methylolated urea or similar compound to improve its crease resistance. Such treatments, however, have the disadvantage that while the crease resistance is improved the breaking strength, abrasion resistance and other desirable characteristics of the textile material are adversely effected. This adverse effect on such properties may be reduced at least to some extent by finishing the textile material with an acrylate polymer or similar polymer but fabrics which have been finished to impart improved crease resistance thereto and with such polymers to avoid significant reduction in breaking strength and other properties tend to have increased wet soiling and undesirable coil release characteristics. Hence, it is usually also necessary to treat the crease resistant textile material to improve its wet soiling and soil release characteristics so it will again resemble the unfinished cellulose fiber. This is difficult, however, because usually a treatment which improves the wet soiling characteristics of a fabric will deleteriously effect the soil release characteristics. In other words, many treating agents which impart good soil release characteristics to a textile fabric will increase the wet soiling significantly. Furthermore, those treatments which are known to improve the soil release and wet soiling characteristics of a fabric made with cellulose fibers often impart an unpleasantly hard "hand" to the fabric. For that reason, such a treatment is seldom used because those materials which can be used to soften the hand of the fabric increase the wet soiling and reduce the soil release behavior.

It is proposed in German Patent Specification No. 1,110,606 to finish woven fabrics containing cellulose fibers with agents which improve the crease resistance thereof and with a mixed polymer of 1% to 12% of an N-methylol amide of an acrylic acid and 99% to 85% of one or more other polymerizable compounds. However, textiles finished in this way have been found to have an increased wet soiling tendency during hot washing.

It is disclosed in German Patent Specification No. 1,209,989 that the wet soiling characteristics of a textile material are not increased when the material is finished to increase its crease resistance if the textile is treated with a mixed polymer prepared from 1 to 10% by weight of residues of N-methylol amide of an acrylic acid, 0.5 to 10% by weight of at least one compound containing not less than two polymerizable double bonds in the molecule and residues of one or several additional polymerizable compounds in an amount required to provide 100% by weight. This disclosed process as well as other known processes for making crease resistant textile fabrics containing cellulose fibers have, however, failed to provide a fabric which combines good dry and wet soiling characteristics similar to that of the unfinished fabric and a good hand.

It is therefore an object of this invention to provide a process for finishing a textile material containing cellulose fibers to improve its crease resistance, soil release and wet soiling characteristics without deleteriously affecting its hand. Another object of the invention is to provide a process for finishing a textile material containing cellulose fibers to provide a fabric having improved crease resistance, good soil release and wet soiling characteristics and a hand which is similar to that of the unfinished textile material. Still another object of the invention is to provide a method for making wash and wear type fabrics having improved crease resistance along with improved soil release and wet soiling characteristics similar to that of the unfinished fabric and a good hand.

The foregoing objects and others are accomplished in accordance with this invention, generally speaking, by providing a process wherein a textile fabric made from fibers including cellulose fibers is finished by treatment with an aqueous dispersion containing from 70 to 97% by weight of an ester of an acrylic acid and a saturated monohydric alcohol having from 1 to 8 carbon atoms and from 30% to 3% by weight of an ester of acrylic acid with an unsaturated monohydric alcohol having from 2 to 5 carbon atoms. The textile material is treated with an aqueous dispersion which contains from 0.3 to 30% by weight of the mixed polymer and may also contain a conventional compound which imparts improved crease resistance to the textile material. The acrylic acid used in making the ester with either the saturated monohydric alcohol or the unsaturated monohydric alcohol may have a straight or branched chain. Preferably, the aqueous dispersion contains from about 0.6 to about 4% by weight of the mixed polymer. Especially good results have been obtained when butyl acrylate is used as the ester of acrylic acid and a saturated monohydric alcohol so butyl acrylate is the preferred ester prepared with the saturated alcohol. Especially good results are also obtained when the ester prepared with the unsaturated alcohol is made with vinyl alcohol or allyl alcohol. The saturated monovalent alcohol may be any monohydric alcohol having 1 to 8 carbon atoms such as, for example, methyl alcohol, ethyl alcohol, propyl alcohol, amyl alcohol, octyl alcohol and the like. Any unsaturated monohydric alcohol having from 2 to 5 carbon atoms such as vinyl alcohol, allyl alcohol, allyl ethyl alcohol and the like may be used.

In the following examples which describe preferred embodiments of the invention all parts are by weight unless otherwise indicated. It should be noted that it was particularly unexpected that a usable result would be obtained without using methylolated amines.

EXAMPLE 1

A series of sixteen 20% latices were prepared from copolymers of butyl acrylate as a component A and a component B identified in Table 1. The copolymers were prepared by emulsion polymerization with a redox system. The resulting latices may be applied to a textile material together with a resin required for cross-linking and the resin can then be cross-linked in the customary manner with the addition of a suitable catalyst.

In preparing each of the latices the following were placed in a one liter flask with agitation:

8.0 g of a 75% solution of sulfosuccinic acid ester of an addition product of 9 mol ethylene oxide to nonyl phenol
0.3 g sodium hydrogen sulfide
1.0 g disodium phosphate
400 g water The flask was thoroughly flushed with nitrogen heated to 50° C. and 0.3 g ammonium persulfate was added. After that, several milliliters of an emulsion of 120 g monomer mixture set forth in Table 1 in a solution of 4.0 g of a 75% solution of sulfosuccinic acid ester of an addition product of 9 mol ethylene oxide to nonyl phenol 0.7 g ammonium persulfate in 67.0 g of water were added from an agitated vessel by means of a metering pump. Polymerization began 5 to 20 minutes after that with formation of a blue color. The remainder of the supply was then added over a period of 3 hours. This was followed by the addition of 0.25 g ammonium persulfate and stirring for an additional 2 hours at 50° C.

The contents of the vessel were then cooled to 20° C. and the suspension was filtered through a cloth in order to remove any coarse coagulated particles. The resulting product was a finely divided latex (color: gray-bluish, transparent) with a pH value of 7 to 8. The pH may be adjusted to 7 with trisodium phosphate where necessary.

Cotton poplin samples were saturated on a pad with a solution containing as a cross-linking resin a methylolated urea, dimethyl dihydroxyethylene urea and one of the mixed polymers no. 1 to 16 of Table 1. Magnesium chloride was added as a cross-linking catalyst. The resulting materials were squeezed to remove liquid until the liquid content was about 70%, dried at 120° C. and heated for 4 minutes to 150° C. in order to cross-link the resin. The finished textile specimens were then examined as follows:

Wet soiling was checked making use of fabric sections which were treated in a beaker with the following bath at 90° C.:

2 g/lit. dodecylbenzosulfonic acid sodium (30%)

0.5 g/lit. carbon black, Printex 140 V (Degussa)

The treatment was continued for about 15 minutes, the liquor ratio (fabric to be tested : bath) was 1 : 50. This was followed by rinsing until clear, first in warm, then in cold running water, drying in air at room temperature and ironing. The degree of wet soiling reported in Table 1 was determined with the "Grey Scale for the Evaluation of Staining" according to DIN 54 002 and SNV 95 805, using a scale of from 1 to 5 (best value 5).

The soil release results reported in Table 1 were determined by AATCC Testing Method 130. In this test, textile specimens measuring about 20 by 20 centimeters were placed on a hard and smooth base. Using a dropping bottle or pipette, five drops of DAB-6 paraffin oil were applied to the test specimen. The paraffin oil spots were covered with a polyethylene film measuring about 7½ by 7½ cm and put under a load of 2.28 kg for one minute. After the load application of one minute, the polyethylene film and the weight were taken off and the oil which had not been absorbed by the fabric was removed with filter paper. The test specimens were then suspended from a line and the oil spotted fabric allowed to dry; time: 15 minutes, to a maximum of two hours. Subsequently, the test specimens were washed in a washing machine.

Loading of the washing machine: not more than 20 test specimens plus so much ballast material that the liquor ratio was 1 : 25.

Number of washing cycles: 5

Detergent: Dixan, 2 g/lit.

Washing temperature: 60° C.

Washing time: 12 min.

Centrifuging: yes

Drying: tumbler; temperature:maximum 80° C.; time: 45 ± 5 min.

The test specimens were evaluated by DMRC scale, with grades from 1 to 5, 5 being the best value.

The hand of the finished fabric reported in Table 1 was determined by two testers who divided the test specimens into four groups, Group 1 having the smoothest and softest hand, Group 4 the roughest and hardest hand, with the latter group being substantially different from the first three.

The crease resistance was evaluated by means of AATCC Testing Method 124-1967T, which has become known as the Monsanto method. The washed textile material was dried on the line and then graded from 1 to 5 by means of the Monsanto recovery replicas, which are plastic replicas representing fabric with different degrees of creasing; 5 is the best value.

The results obtained with Samples 1 through 17 of Table 1 are compiled in such a way that the composition of the copolymer is given first for each of the tests. Then the composition of the bath and subsequently the evaluation of wet soiling, soil release behavior and hand, as well as the grade of the Monsanto replica are given. The results in the table show clearly that the samples prepared in accordance with the invention are significantly superior to the results heretofore obtainable with finished fabrics. Only the samples produced in accordance with the invention combined all of the important characteristics required for finishing fabrics containing cellulose fibers.

Table 1

| | Mixed Polymer 20% latex | | The bath contains: | | | Wet | Soil | | Monsanto |
|---|---|---|---|---|---|---|---|---|---|
| No. | Component A Butyl acrylate | Component B | Polymer latex g/lit. | Reactive resin g/lit. | $MgCl_2$ g/lit. | Soiling Grade | Release Grade | Hand Group | Replica No. |
| 1 | 75% | 25% allyl acrylate | 30 | 60 | 12 | 4–5 | 5 | 2 | 4 |
| 2 | 90% | 10% allyl acrylate | 30 | 60 | 12 | 4–5 | 5 | 3 | 4 |
| 3 | 95% | 5% allyl acrylate | 30 | 60 | 12 | 4–5 | 4–5 | 3 | 4 |
| 4 | 95% | 5% vinyl acrylate | 30 | 60 | 12 | 4–5 | 3 | 3 | 4 |
| 5 | 75% | 25% vinyl acrylate | 30 | 60 | 12 | 4–5 | 4–5 | 2 | 4 |
| 6 | 95% | 5% vinyl-methacrylate | 30 | 60 | 12 | 4–5 | 4–5 | 3 | 4 |
| 7 | 75% | 25% vinyl-methacrylate | 30 | 60 | 12 | 4–5 | 5 | 2 | 4 |
| 8 | 75% | 25% allyl methacrylate | 30 | 60 | 12 | 4–5 | 4–5 | 2 | 4 |
| 9 | 75% | 25% diallyl phthalate | 30 | 60 | 12 | 2–3 | 4–5 | 3 | 4 |
| 10 | 95% | 5% glycol di- | 30 | 60 | 12 | 2–3 | 3 | 3 | 3 |

Table 1-continued

| No. | Mixed Polymer 20% latex: Component A Butyl acrylate | Component B | The bath contains: Polymer latex g/lit. | Reactive resin g/lit. | $MgCl_2$ g/lit. | Wet Soiling Grade | Soil Release Grade | Hand Group | Monsanto Replica No. |
|---|---|---|---|---|---|---|---|---|---|
| | | methacrylate | | | | | | | |
| 11 | 75% | 25% glycol dimethacrylate | 30 | 60 | 12 | 3 | 4–5 | 3 | 3 |
| 12 | 95% | 5% butanediol diacrylate | 30 | 60 | 12 | 2–3 | 3–4 | 3 | 1–2 |
| 13 | 75% | 25% butanediol diacrylate | 30 | 60 | 12 | 1–2 | 5 | 3 | 1–2 |
| 14 | 95% | 5% hexanediol diacrylate | 30 | 60 | 12 | 2–3 | 4–5 | 3 | 1–2 |
| 15 | 75% | 25% hexanediol diacrylate | 30 | 60 | 12 | 1–2 | 3 | 3 | 1–2 |
| 16 | 80% | 5% allyl acrylate 15% acrylic acid | 30 | 60 | 12 | 5 | 5 | 4 | 1–2 |
| 17 | Untreated fabric | | | | | 5 | 5 | — | — |

The reactive resin used was dimethylol dihyroxyethylene urea.

EXAMPLE 2

Cotton poplin was impregnated in a bath containing 120 parts of a 20% aqueous dispersion of a mixed polymer from Table 2, 40 parts dimethylol propylene urea or 40 parts dimethylol dihydroxyethylene urea, and 15 parts magnesium chloride in 1000 parts of water. The material was squeezed out to a content of 80%, dried at 100° C. and heated for 5 minutes to 150° C.

The results are compiled in Table 2. It is found that, so far as wet soiling is concerned, the finishes pursuant to the invention produce substantially better results than the other bath compositions corresponding to the state of the art described hereinbefore.

Table 2

| No. | Composition of the Polymer: Component A | Component B | N-methylol-methacrylamide | Resin | Wet Soiling Grade |
|---|---|---|---|---|---|
| 1 | 95% butyl-acrylate | 5% butanediol diacrylate | — | Dimethylol propylene urea | 2 |
| 2 | 90% butyl-acrylate | 5% butanediol diacrylate | 5% | " | 2 |
| 3 | 75% butyl-acrylate | 25% allyl acrylate | — | " | 4–5 |
| 4 | 95% butyl-acrylate | 5% allyl acrylate | — | " | 4–5 |
| 5 | 95% butyl-acrylate | 5% butanediol diacrylate | — | Dimethylol dihydroxy-ethylene urea | 2 |
| 6 | 90% butyl-acrylate | 5% butanediol diacrylate | 5% | " | 2 |
| 7 | 75% butyl-acrylate | 25% allyl acrylate | — | " | 4–5 |
| 8 | — | — | — | " | 4–5 |
| 9 | — | — | — | Dimethylol propylene urea | 4–5 |

EXAMPLE 3

Finishing agents were compared in this example which, on one hand, correspond to those of the invention, and on the other hand were commercially available products for the application purposes being dealt with here. Product A is an acrylate especially recommended for soil release finishing, product B is a commercially available polyethylene emulsion and product C a polyacrylate with methylolated amide groups.

Cotton poplin was treated in a bath containing in one thousand parts of water 60 parts dimethylol dihydroxyethylene urea and 12 parts magnesium chloride, as well as varying proportions of a copolymer, i.e. in experiments 1 to 9 inclusive, a copolymer pursuant to the invention consisting of 75% butyl acrylate and 25% allyl acrylate; in experiments 10–18, it contains product A, in experiments 19 to 27 it contains product B, and in experiments 28 to 36, product C. The results are compiled in Table 3.

Table 3

| No. | Preparation Used | Polymer in the bath g/lit. | Wet Soiling Grade | Soil Release Grade | Hand Group |
|---|---|---|---|---|---|
| 1 | Polymer pursuant to the invention | 4 | 4–5 | 5 | 3 |
| 2 | " | 8 | 4–5 | 5 | 3 |
| 3 | " | 16 | 4 | 5 | 2 |
| 4 | " | 24 | 4–5 | 5 | 2 |
| 5 | " | 32 | 4–5 | 5 | 2 |
| 6 | " | 40 | 4–5 | 5 | 2 |
| 7 | " | 48 | 4–5 | 4–5 | 2 |
| 8 | " | 56 | 5 | 4–5 | 2 |
| 9 | " | 64 | 5 | 4–5 | 2 |
| 10 | Product A | 4 | 3 | 5 | 3 |
| 11 | " | 8 | 3 | 5 | 3 |
| 12 | " | 16 | 5 | 5 | 3 |
| 13 | " | 24 | 2–3 | 5 | 3 |
| 14 | " | 32 | 2–3 | 5 | 3 |
| 15 | " | 40 | 3 | 5 | 3 |
| 16 | " | 48 | 3 | 5 | 3 |
| 17 | " | 56 | 3 | 5 | 3 |
| 18 | " | 64 | 3 | 5 | 3 |
| 19 | Product B | 4 | 3 | 3 | 1 |
| 20 | " | 8 | 3 | 3 | 1 |
| 21 | " | 16 | 2–3 | 3 | 1 |
| 22 | " | 24 | 2–3 | 3 | 1 |
| 23 | " | 32 | 2 | 3 | 1 |
| 24 | " | 40 | 2 | 3 | 1 |
| 25 | " | 48 | 2 | 3 | 1 |
| 26 | " | 56 | 2 | 3 | 1 |

Table 3-continued

| No. | Preparation Used | Polymer in the bath g/lit. | Wet Soiling Grade | Soil Release Grade | Hand Group |
|---|---|---|---|---|---|
| 27 | " | 64 | 2 | 3 | 1 |
| 28 | Product C | 4 | 1–2 | 5 | 4 |
| 29 | " | 8 | 1–2 | 5 | 4 |
| 30 | " | 16 | 1–2 | 5 | 4 |
| 31 | " | 24 | 1–2 | 5 | 4 |
| 32 | " | 32 | 1–2 | 5 | 4 |
| 33 | " | 40 | 1–2 | 5 | 4 |
| 34 | " | 48 | 1–2 | 5 | 4 |
| 35 | " | 56 | 1–2 | 5 | 4 |
| 36 | " | 64 | 1–2 | 5 | 4 |

EXAMPLE 4

Polyester-cotton blend fabrics and cotton fabrics were treated on a pad in a bath containing per thousand parts of water 60 parts dimethylol dihydroxyethylene urea, 12 g of a tallow fatty alcohol ethoxylated with 8 mol and sulfated, as softening agent, 3.5 parts Tinopal 2 RT (optical brightener of the firm Geigy), 12 parts $MgCl_2.6H_2O$ and furthermore 30 parts of one of the commercially available product A polymer latices (polyacrylate containing 40% methylolated amides), product B (40% polyethylene latex), or a 20% latex pursuant to the invention, of the monomer composition of 75% butyl acrylate and 25% allyl acrylate. As in the preceding examples, the fabric was dried and heated in order to cross-link the resin. Wet soiling was determined as described in Example 1, but followed by washing one to five times as in the soil release test. A soil release test was carried out in addition, in which the fabric was soiled with carbon black and synthesized sebaceous matter (Goette, Tenside 4, 209–217 (1967)).

Execution of the carbon black-sebaceous matter test: one gram of carbon black was mixed well with 250 g sebaceous matter in a mixing unit. The mixture was spread on a rubbing fastness fabric (DIN 54021) and twice squeezed out on a pad, once without, and once with accompanying fabric, whereby care must be taken so that the squeezing pressure will remain unchanged during the entire test series. The fabric treated in this manner was used to rub the test specimen 20 times using a Crocmeter (DIN 54021) with a 500 g load. After that, it was stored in the drying chest at 40° C. and, as in the abovedescribed soil release test (AATCC Testing Method 130), washed once and graded. The results of the wet soiling and sebaceous matter release tests are contained in Table 4.

Table 4

| | | Wet Soiling | | | | |
|---|---|---|---|---|---|---|
| | | Without Additional Washing | 1st Washing Cycle | 5th Washing Cycle | 10 Washing Cycles | Sebaceous Matter Test |
| Polyester-Cotton | Not finished | 4–5 | | | | 1 |
| | Finished without polymer | 4–5 | 4–5 | 4–5 | 4–5 | 1 |
| | Product A | 3 | 3–4 | 4 | 4 | 1–2 |
| | Product B | 4–5 | 4–5 | 4–5 | 4–5 | 1 |
| | Polymer pursuant to the invention | 5 | 5 | 5 | 5 | 2–3 |
| Cotton | Not finished | 2–3 | | | | 1 |
| | Finished without polymer | 4 | 4–5 | 5 | 5 | 3 |
| | Product A | 2–3 | 4 | 4 | 4 | 2 |
| | Product B | 3 | 3–4 | 4 | 4 | 2 |
| | Polymer pursuant to the invention | 4 | 4–5 | 5 | 5 | 3–4 |

Although the invention is described in detail for the purpose of illustration, it is to be understood that such detail is solely for that purpose and that variations can be made therein by those skilled in the art without departing from the spirit and scope of the invention except as it may be limited by the claims.

Any suitable resin adapted to impart crease resistance to a fabric containing cellulose fibers may be used in the latex provided by this invention such as, for example, dimethylol urea, dimethylol propylene urea, dimethylol dihydroxyethylene urea, hexamethylol melamine methylether, dimethylolhydroxyethyl carbamat, dimethylol isopropyl carbamat etc.

I claim:

1. In a process for the wash-and-wear finishing of textile materials containing cellulose fibers with aqueous dispersions of mixed polymers of compounds of acrylic acid with at least one polymerizable compound, the improvement wherein a textile material is treated with an aqueous dispersion which contains 0.3 – 30% by weight of a mixed polymer of components A and B, whereby the mixed polymer contains as component A 70 to 97% by weight of an ester of acrylic acid with a monohydric alcohol having 1 to 8 carbon atoms and as component B 30 to 3% by weight of an ester of acrylic acid with an unsaturated monohydric alcohol having 2 to 5 carbon atoms.

2. The process of claim 1 wherein the aqueous dispersion contains 0.6 to 4% by weight of the mixed polymer.

3. The process of claim 1 wherein the mixed polymer contains 70 – 97% by weight of butyl acrylate as component A.

4. The process of claim 1 wherein the mixed polymer contains 3 – 30% by weight of an ester of acrylic acid with vinyl alcohol as component B.

5. The process of claim 1 wherein the mixed polymer contains 3 – 30% by weight of an ester of acrylic acid with allyl alcohol as component B.

6. The process of claim 1 wherein components A and B are esters of acrylic acid or of an alkyl substituted acrylic acid.

7. The process of claim 6 wherein the saturated alcohol has a straight or branched chain.

8. The process of claim 7 wherein the unsaturated alcohol has a straight or branched chain.

9. In a process for finishing a fabric containing cellulose fibers to improve its crease resistance, soil release and wet soiling properties while retaining a hand similar to that of the fabric prior to finishing which comprises saturating the fabric with an aqueous latex which will improve the crease-resistance of the fabric, the improvement which comprises including in the latex the polymerization product of a mixture of from about 70% to about 97% by weight of an ester of acrylic acid and a saturated monohydric alcohol having 1 to 8 carbon atoms and from about 30% to about 3% of an ester of acrylic acid and an unsaturated monohydric alcohol having 2 to 5 carbon atoms.

10. The process of claim 9 wherein the latex contains dimethylol dihydroxyethylene urea or dimethylol propylene urea.

11. The process of claim 9 wherein the latex contains a methylolated urea.

* * * * *